US005969301A

United States Patent [19]

Cullum, Jr. et al.

[11] Patent Number: 5,969,301

[45] Date of Patent: Oct. 19, 1999

[54] ACOUSTIC DIFFUSER PANEL SYSTEM AND METHOD

[76] Inventors: Burton E. Cullum, Jr.; Debbie L. Cullum, both of 19312 Apple Springs Dr., Leander, Tex. 75051

[21] Appl. No.: 08/772,501

[22] Filed: Dec. 23, 1996

[51] Int. Cl.[6] ..... E04B 1/82

[52] U.S. Cl. ..... 181/286; 181/295

[58] Field of Search ..... 181/210, 284, 181/285, 286, 290, 293, 295; 52/144, 145

[56] References Cited

U.S. PATENT DOCUMENTS

| | | | |
|---|---|---|---|
| 4,226,299 | 10/1980 | Hansen | 181/295 |
| 4,244,439 | 1/1981 | Wested | 181/210 |
| 4,821,839 | 4/1989 | D'Antonio et al. | 181/286 |
| 5,401,921 | 3/1995 | D'Antonio et al. | 181/286 |

*Primary Examiner*—Khanh Dang

*Attorney, Agent, or Firm*—Akin. Gump, Strauss, Hauer & Feld,L.L.P.

[57] ABSTRACT

An acoustic diffuser panel for diffusing sound of a range of frequencies comprises a sound reflective surface having a plurality of generally parabolic shaped wells interconnected by arcuate junctions. The shaped wells are bounded by an outer lip. The sound reflective surface of the panel is generally curvilinear. The number of wells of the panel is equal to a modulus. The modulus is the lowest prime number exceeding the quotient of the highest frequency of the range of frequencies divided by the lowest frequency of the range of frequencies. The wells at their opening each have particular width less than or equal to the quotient of the speed of sound divided by the product of two times the lowest frequency of the range of frequencies. Each well has a depth equal to a value of a quadratic residue number theory sequence, $n^2$(modulus N), multiplied by a constant equal to the frequency wavelength of the lowest frequency divided by the product of two times the modulus, wherein n is equal to each integer from 0 to N−1. The acoustic diffuser panel is manufacturable as a single integral unit by molding.

14 Claims, 3 Drawing Sheets

ACOUSTIC DIFFUSER PANEL SYSTEM AND METHOD

BACKGROUND OF THE INVENTION

The present invention relates to an acoustical panel and, more particularly, to an acoustic diffuser panel constructed as an integral unit and configured with wells according to the results obtained from a quadratic-residue number theory sequence.

Acoustic panels having well diffusers are generally conventional. Hansen, for example, discloses in U.S. Pat. No. 4,226,299 (the '299 Patent) an acoustic panel having a parabolic-sinusoidal surface configuration. The panel is formed as a single unit with a plurality of peaks and wells. The panel has curvilinear surfaces. The curvilinear surfaces define equi-depth wells and equi-height peaks. Each well and each peak, respectively, of the panel have equal width. The wells are each filled with flat connecting sections, and sound absorbing portions are centered within each of the wells. Each sound absorbing portion protrudes from its respective well for the height of the peaks.

A deficiency of the acoustic panel of the '299 Patent is that each peak and well of the panel is identical to each other peak and well thereof. Such a uniform configuration is not necessarily optimal for sound diffusion over a typical range of sound frequencies encountered in any given application. More optimal configurations for the typical ranges of frequencies have been mathematically derived, and acoustic diffuser panels have been configured accordingly.

An acoustic diffuser panel which has non-uniform wells according to a mathematically derived design is disclosed by D'Antonio et al., for example, in U.S. Pat. Nos. 4,821,839 and 5,027,920 (the "839 Patent" and "920 Patent", respectively). The acoustic panels are block modular diffusers. The panels are formed with wells of varying depths. The desired well depths for a particular application are, in each instance, determined according to a mathematical formula, referred to as a quadratic-residue number theory sequence. The wells each have corresponding parallel walls and are generally rectangular with 90° angles. The walls of the wells of the acoustic panels are formed from discrete divider elements. Fiberglass inserts of varying thickness are positioned between corresponding walls to partially fill the wells to obtain desired well depths according to the mathematical formula.

A drawback to the acoustic panel disclosed in the '839 Patent is that the panel cannot easily be integrally molded as a single unitary piece. This is the case because, in removal of the panel's parallel side walls from molds, shear forces would typically destroy the materials of the panel and make such removal hard if not impossible. Piecemeal fabrication of the acoustic panels is, therefore, necessary. Such piecemeal fabrication is tedious and costly, relative to fabrication of molded panels. Disadvantages are also exhibited by the acoustic panel of the '920 Patent. In particular, the disclosed acoustic panel is formed from cinder or concrete blocks. Such blocks lack certain desirable acoustic characteristics of molded materials, such as fiberglass. Also, panels of such blocks are likely unwieldy and weighty, limiting the placement of the panels for service and limiting the potential applications for the panels. Like the panels of the '839 Patent, the piecemeal fabrication of the acoustic panels of the '920 Patent is also relatively tedious and costly.

Therefore, what is needed is a system and method for sound diffusion that overcomes these and other problems with conventional acoustic diffuser panels and that provides manufacturing and cost advantages, ready and easy adaptability as a replacement for conventional acoustical ceiling tiles, and improved sound diffusion.

SUMMARY OF THE INVENTION

The present invention, accordingly, provides a system and method for sound diffusion by an acoustic diffuser panel that overcomes the drawbacks of conventional acoustic diffuser panels and, additionally, provides manufacturing and cost advantages, ready and easy adaptability as a replacement for conventional acoustical ceiling tiles, and improved sound diffusion.

To this end, an embodiment of the invention is an acoustical diffuser for diffusing sound having a range of frequencies from a low frequency to a high frequency. The acoustical diffuser comprises a panel having a plurality of wells formed thereon. The wells each have particular width equal to the speed of sound divided by the product of two times the low frequency of the range of frequencies and the wells each have different particular depth equal to a value of a quadratic residue number theory sequence, $n^2$(modulus), multiplied by a constant equal to the frequency wavelength of the low frequency divided by the product of two times the modulus. The modulus is the lowest prime number exceeding the quotient of the high frequency divided by the low frequency and n is equal to each integer from 0 to the modulus minus 1.

Another embodiment of the invention is a system for diffusing sound of frequencies in a range from a low frequency to a high frequency. The system comprises a panel formed with curvilinear wells equal in number to the next prime number greater than the quotient of the high frequency divided by the low frequency. The system also comprises a tile grid for retaining and supporting the panel in service.

Yet another embodiment of the invention is an acoustic diffuser. The acoustic diffuser comprises a sound reflective surface having a plurality of generally parabolic shaped wells interconnected by arcuate junctions. The plurality of generally parabolic shaped wells is bounded by an outer lip. The entire sound reflective surface comprises generally curvilinear portions.

Another embodiment of the invention is a method of manufacturing an acoustic diffuser panel. The method comprises the steps of constructing a mold of a generally curvilinear surface having a plurality of generally parabolic peaks and an outer edge bordering the plurality of generally parabolic peaks, waxing the mold with a release agent, spraying the mold with a catalyzed gel coat, allowing the catalyzed gel coat to harden, applying a chopped strand mat over the catalyzed gel coat, saturating the chopped strand mat with catalyzed resin, allowing the chopped strand mat saturated with catalyzed resin to harden until semi-solid, trimming the chopped strand mat to fit the mold, curing the chopped strand mat saturated with catalyzed resin, and removing the catalyzed gel coat and the chopped strand mat with catalyzed resin from the mold.

An advantage of the present invention is that the panel diffuses sound into many directions because of the varying well depths and the curvilinear surfaces defining the wells and the whole of the panel. The diffusion achieved is an enhancement of that achieved with uniform wells and peaks and with squared wells.

Another advantage of the present invention is that the panel is fabricated by molding, as a single integral unit. The fabrication is less tedious and less costly than the fabrication of panels comprised of a composite of pieces. The fabrication by molding the panel in accordance with the present invention is possible because of canted side walls of the wells of the panel.

Yet another advantage of the present invention is that the panel can replace conventional acoustical ceiling tiles in a conventional ceiling tile grid. Thus, the panel is easily and readily placed and maintained for service in an application.

DETAILED DESCRIPTION OF THE PREFERRED EMBODIMENT

Figure 1:
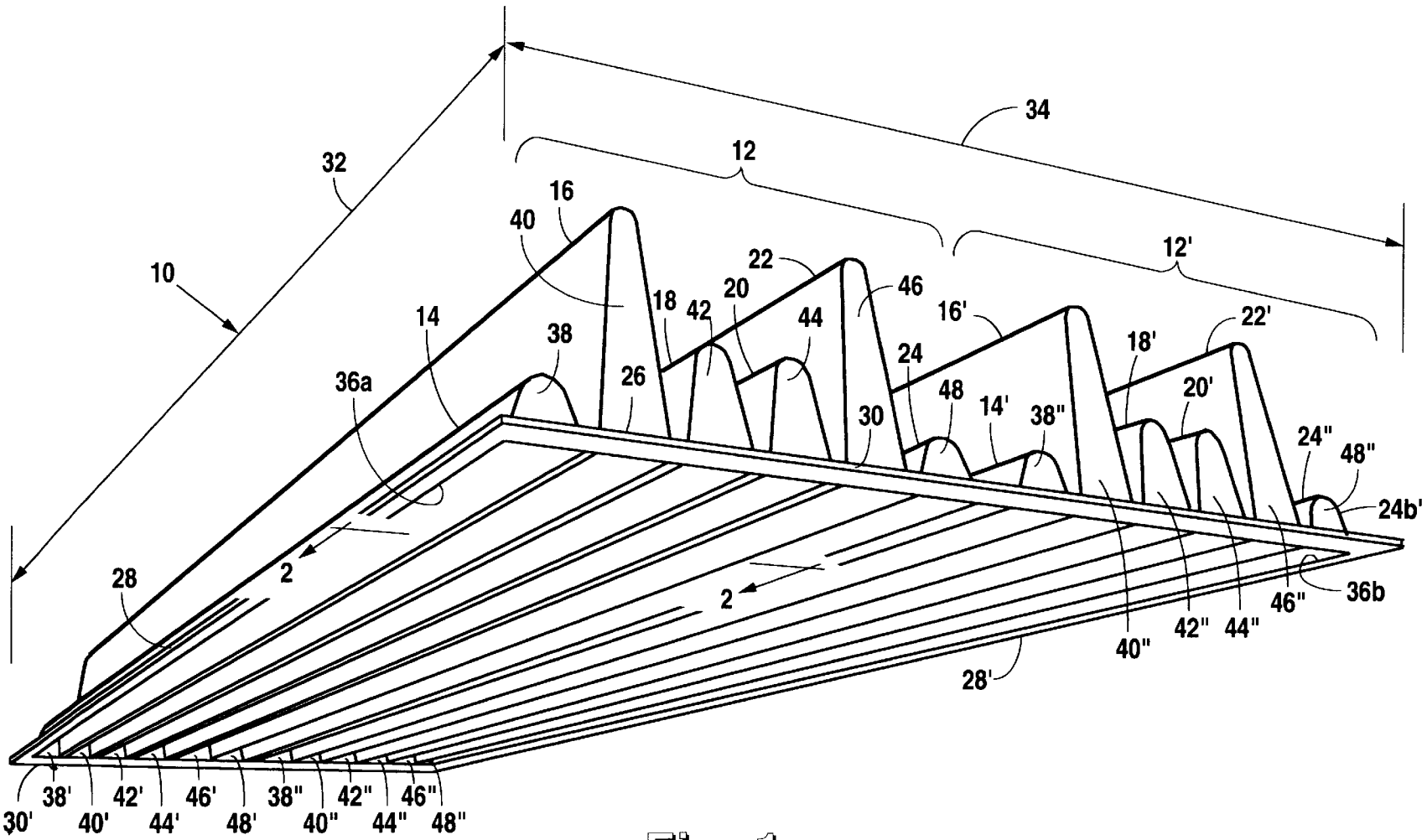
FIG. 1 shows a perspective view of an acoustic diffuser panel according to embodiments of the present invention.

Referring to FIG. 1, the reference numeral 10 refers, in general, to an acoustic diffuser panel according to certain embodiments of the present invention. The acoustic diffuser panel 10 is generally rectangular and has a shaped sequence 12. The shaped sequence 12 comprises a plurality of wells 14, 16, 18, 20, 22, and 24. The wells 14, 16, 18, 20, 22, and 24 extend upwardly as viewed in FIG. 1. A shaped sequence 12', adjacent the shaped sequence 12, is identical to the shaped sequence 12 and, thus, repeats the pattern of the wells 14, 16, 18, 20, 22, and 24 as wells 14', 16', 18', 20', 22', and 24', respectively. An outer lip 26 connects to the shaped sequences 12 and 12' of the panel 10 and extends around the periphery of the shaped sequences 12 and 12'.

The panel 10 has first opposing edges 28 and 28' and second opposing edges 30 and 30', each formed by the outer lip 26. The wells 14, 16, 18, 20, 22, and 24 and the wells 14', 16', 18', 20', 22', and 24' each extend longitudinally along substantially a length 32 of the panel 10, ending in the outer lip 26 of the first opposing edges 28 and 28'. The wells 14, 16, 18, 20, 22, and 24 and the wells 14', 16', 18', 20', 22', and 24' are sequentially located, side by side, along substantially a width 34 of the panel 10. An outer edge 36*a* of the well 14 and an outer edge 36*b* of the well 24' connect to the outer lip 26 of the first opposing edges 28 and 28', respectively. At the outer lip 26 of the second opposing edges 30 and 30', the well ends 38 and 38', 40 and 40', 42 and 42', 44 and 44', 46 and 46', and 48 and 48' cover ends of the wells 14, 16, 18, 20, 22, and 24, respectively, and connect the wells 14, 16, 18, 20, 22, and 24 to the outer lip 26. Also at the outer lip 26 of the second opposing edges 30 and 30', the well ends 38" and 38'", 40" and 40'", 42" and 42'", 44" and 44'", 46" and 46'", and 48" and 48'" cover ends of the wells, 14', 16', 18', 20', 22', and 24', respectively, and connect the wells 14', 16', 18', 20', 22', and 24' to the outer lip 26.

Figure 2:
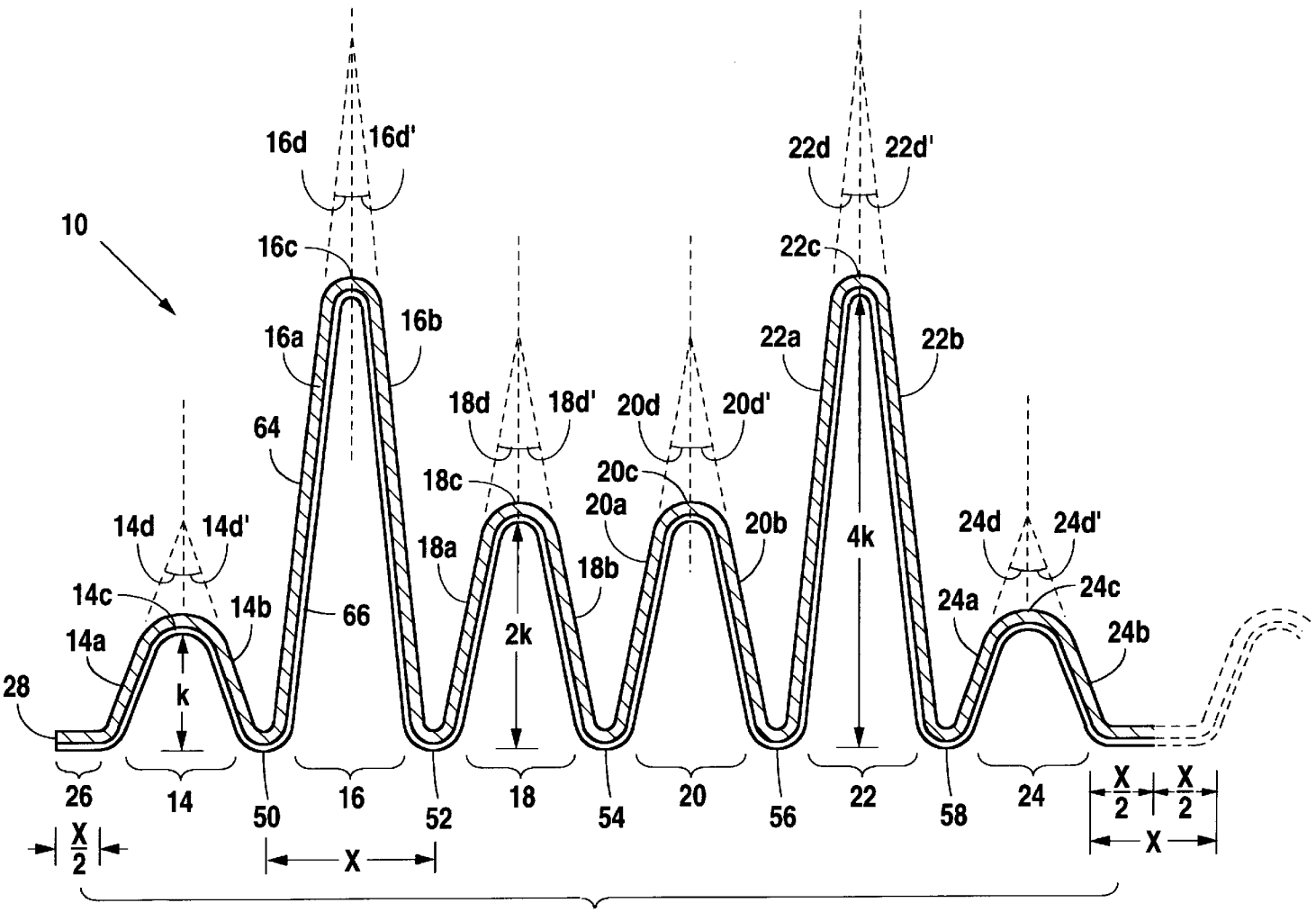
FIG. 2 shows an elevational view of a cross-section of the acoustic diffuser panel of FIG. 1 taken along the line 2—2 of FIG. 1.

Referring to FIG. 2, it can be appreciated that all bends of the shaped sequence 12 of the panel 10 are curvilinear. Extending upwardly (as shown in FIG. 2) to form the wells 14, 16, 18, 20, 22, and 24 are first well walls 14*a*, 16*a*, 18*a*, 20*a*, 22*a*, and 24*a* and second well walls 14*b*, 16*b*, 18*b*, 20*b*, 22*b*, and 24*b*, respectively, connected by arcuate tops 14*c*, 16*c*, 18*c*, 20*c*, 22*c*, and 24*c*, respectively. The first well walls 14*a*, 16*a*, 18*a*, 20*a*, 22*a*, and 24*a* and the second well walls 14*b*, 16*b*, 18*b*, 20*b*, 22*b*, and 24*b*, respectively corresponding thereto, are not vertically (as shown in FIG. 2) parallel. Instead, corresponding pairs of the first well walls 14*a*, 16*a*, 18*a*, 20*a*, 22*a*, and 24*a* and the second well walls 14*b*, 16*b*, 18*b*, 20*b*, 22*b*, and 24*b* are symmetrically canted from vertical (as shown in FIG. 2) by angles 14*d* and 14*d'*, 16*d* and 16*d'*, 18*d* and 18*d'*, 20*d* and 20*d'*, 22*d* and 22*d'*, and 24*d* and 24*d'*, respectively, for each corresponding pair. The angles 14*d* and 14*d'*, 16*d* and 16*d'*, 18*d* and 18*d'*, 20*d* and 20*d'*, 22*d* and 22*d'*, and 24*d* and 24*d'* of corresponding pairs of the first well walls 14*a*, 16*a*, 18*a*, 20*a*, 22*a*, and 24*a* and the second well walls 14*b*, 16*b*, 18*b*, 20*b*, 22*b*, and 24*b*, respectively, may vary among the wells 14, 16, 18, 20, 22, and 24 according to desired configuration of the wells 14, 16, 18, 20, 22, and 24 for desirable sound diffusion by the panel 10. Arcuate junctions 50, 52, 54, 56, and 58 connect the second well wall 14*b* and the first well wall 16*a*, the second well wall 16*b* and the first well wall 18*a*, the second well wall 18*b* and the first well wall 20*a*, the second well wall 20*b* and the first well wall 22*a*, and the second well wall 22*b* and the first well wall 24*a*, respectively. The first well wall 14*a* of the well 14 connects, via the outer edge 36, to the outer lip 26 at edge 28. As shown in FIG. 1, the shaped sequence 12' of the panel 10 is substantially identical to the shaped sequence 12, however, a second well wall 24*b'* of the well 24' connects, via the outer edge 36*b*, to the outer lip 26 at the edge 28'.

Referring to FIGS. 1 and 2, in conjunction, the wells 14, 16, 18, 20, 22, and 24 of the shaped sequence 12 of the acoustic diffuser panel 10 serve to diffuse or "reflect" sound over a range of sound frequencies, according to the configuration of the wells 14, 16, 18, 20, 22, and 24. The same is true of the wells 14', 16', 18', 20', 22', and 24' of the shaped sequence 12'. The shaped sequences 12 and 12' are each a series for sound diffusion configured according to a quadratic residue number theory sequence. Widths and depths of the wells 14, 16, 18, 20, 22, and 24 are determined, and the panel 10 is configured with the wells 14, 16, 18, 20, 22, and 24 of those widths and depths, according to the quadratic residue number theory sequence in order to provide desirable sound diffusion over the range of sound frequencies. The quadratic residue number theory sequence is repeated to configure the wells 14', 16', 18', 20', 22', and 24 of the shaped sequence 12' of the panel 10 for the particular circumstance of the range of sound frequencies.

Referring to the shaped sequence 12, with the understanding that the shaped sequence 12' is substantially identical, each of the wells 14, 16, 18, 20, 22, and 24 has equal width at its opening. A maximum well width x is calculated according to the following formula:

$$\text{maximum well width } x = \text{speed of sound}/(2 \times f_{high})$$

where the "speed of sound" is in feet/second, "$f_{high}$" is the frequency in hertz of the highest frequency of the range of sound frequencies, and "maximum well width x" is in feet. A minimum deepest well depth y is calculated according to the following formulas:

$$\text{frequency wavelength} = \text{speed of sound}/f_{low}$$

where the "speed of sound" is in feet/second, "$f_{low}$" is the frequency in hertz of the lowest frequency of the range of sound frequencies, and the "frequency wavelength" is in feet. Then, $$\text{minimum deepest well depth } y = \text{frequency wavelength}/4$$

where the "frequency wavelength" is in inches and the "minimum deepest well depth y" is in inches.

A prime number N is also calculated according to the following formulas:

$$f_{high}/f_{low}=z$$

and $$\text{prime number } N=\text{lowest prime number greater than } z$$

where "$f_{high}$" and "$f_{low}$" are each in hertz and the "prime number N" is the lowest prime number that is greater than the quotient of $f_{high}$ divided by $f_{low}$. Though a prime number is preferred under the number theory, a non-prime integer may alternatively be employed in the calculations. The prime number N (or other integer, as the case may be) is employed to construct a quadratic residue number theory sequence based on a formula, $n^2$ (modulo N), where N is the prime number for the sequence. This formula was developed by Karl Frederick Gauss and is conventional.

Simply, the quadratic residue number theory sequence is constructed for the prime number N, which is the modulus number, as follows. A residue sequence is determined for each of the integers from n=O to n=N−1. Then, each n (i.e., for O to N−1) is squared and divided by the prime number N. The remainder of each division operation gives the residue sequence.

In order to configure an acoustic panel diffuser based on the residue sequence, each of the integers from n=O to n=N−1 corresponds to a well of the panel 10. In the case of the shaped sequence 12 of the panel 10, n=O corresponds to the outer lip 26 of the edge 28, n=1 corresponds to the well 14, n=2 corresponds to the well 16, n=3 corresponds to the well 18, n=4 corresponds to the well 20, n=5 corresponds to the well 22, and n=6 corresponds to the well 24. It is of note that the widths of the wells 14, 16, 18, 20, 22, and 24 are each equal to the maximum well width x, however, the outer lip 26 of the edge 28 is equal in width to the well width x/2. This is the case because, as shown in FIG. 1, the shaped sequence 12 is repeated as the shaped sequence 12' of the acoustic diffuser panel 10 and each of the shaped sequences 12 or 12' contributes the well width x/2 to achieve the maximum well width x for wells corresponding to n=O. Also the panel, when in use, abuts either another adjacent acoustic diffuser panel (not shown) identical to the panel 10 or an adjacent flat surface, such as a conventional acoustical ceiling tile 60 (shown in phantom in FIG. 3). In this case, the additional well width x/2 to provide the appropriate width of the maximum well width x for n=O is provided by either the adjacent acoustic diffuser panel or the adjacent flat surface. A depth for each of the wells 14, 16, 18, 20, 22, and 24 according to the residue sequence for n=O to n=N−1 is calculated by the following formula:

$$\text{well depth}(n)=\text{remainder}(n)\times\text{frequency wavelength}/2\times\text{prime number } N$$

where "remainder(n)" is the remainder of the division operation for the integer n, "frequency wavelength" is in feet, and "well depth(n)" is the appropriate depth of a well corresponding to the integer n of the residue sequence.

An example of use of the formulas and construction of a quadratic residue number theory sequence for an example range of sound frequencies follows:

EXAMPLE

For purposes of the example, the frequency range of the sound is assumed to be from 600 Hz to 3,340 Hz. The speed of sound is assumed to be 1,115 feet/second for purposes of the example, however, those skilled in the art will know and appreciate that the speed of sound may vary because of temperature, humidity, and other factors.

First, the maximum well width x is calculated as follows:

$$\text{maximum well width } x=1{,}115/(2\times3{,}340)=0.1669'=2.0028''$$

Second, the minimum deepest well depth y is calculated as follows:

$$\text{frequency wavelength}=1{,}115/600=1.8583'=22.2999''$$

and $$\text{minimum deepest well depth } y=22.2999''/4=5.57499''$$

Third, the prime number N is calculated as follows:

$$3{,}340/600=5.5666$$

and $$\text{prime number } N=7\text{(i.e., the next higher prime number)}$$

Finally, the quadratic residue number theory sequence is constructed based on the prime number N=7, which is the modulus number for the sequence.

The prime number 7 quadratic residue sequence according to the formulas and calculations herein described is as shown in TABLE A, below. The number in TABLE A under the column headed $n^2$(mod 7) is the remainder (or "residue") after dividing $n^2$ by the modulus number 7. The well depth(n) for each of the wells corresponding to n=O to n=N−1 is then calculated according to the formula previously described. In the example, the calculation yields the particular values shown in TABLE A, below.

TABLE A

| Well(s) | n | $n^2$ | $n^2$ (mod 7) | Well Depth* | Well Depth (inches) |
|---|---|---|---|---|---|
| 26 (×2) | 0 | 0 | 0 | 0 | 0 |
| 14 | 1 | 1 | 1 | 1k | 1.6 |
| 16 | 2 | 4 | 4 | 4k | 6.4 |
| 18 | 3 | 9 | 2 | 2k | 3.2 |
| 20 | 4 | 16 | 2 | 2k | 3.2 |
| 22 | 5 | 25 | 4 | 4k | 6.4 |
| 24 | 6 | 36 | 1 | 1k | 1.6 |

*where k is a constant equal to frequency wavelength/2 × prime number N (refer to discussion, above, of calculation of well depth (n))

These quadratic residue number theory sequence results from the calculations are used to configure the panel 10, which is shown in FIG. 1.

Of course, these calculations and corresponding configuration of the panel 10 are only examples. The calculations and configuration of acoustic diffuser panels, in any instance of sound frequency range, depends upon the range of sound frequencies to be diffused by the panels. For example, and not by way of limitation, panels can be configured with more or less wells, each of a different width and different depth than those shown in the Figures and in the Tables. Furthermore, panels are configurable with additional or fewer sequences of wells, for example, three sequences of the wells may be included in a single panel, according to the quadratic residue number theory sequence obtained in any instance and depending upon the size of the panels and the number and dimensions of wells. It is to be understood and appreciated by those skilled in the art that the calculations and configurations expressly stated herein are only examples and are not intended to be exclusive or limiting to the description.

Figure 3:
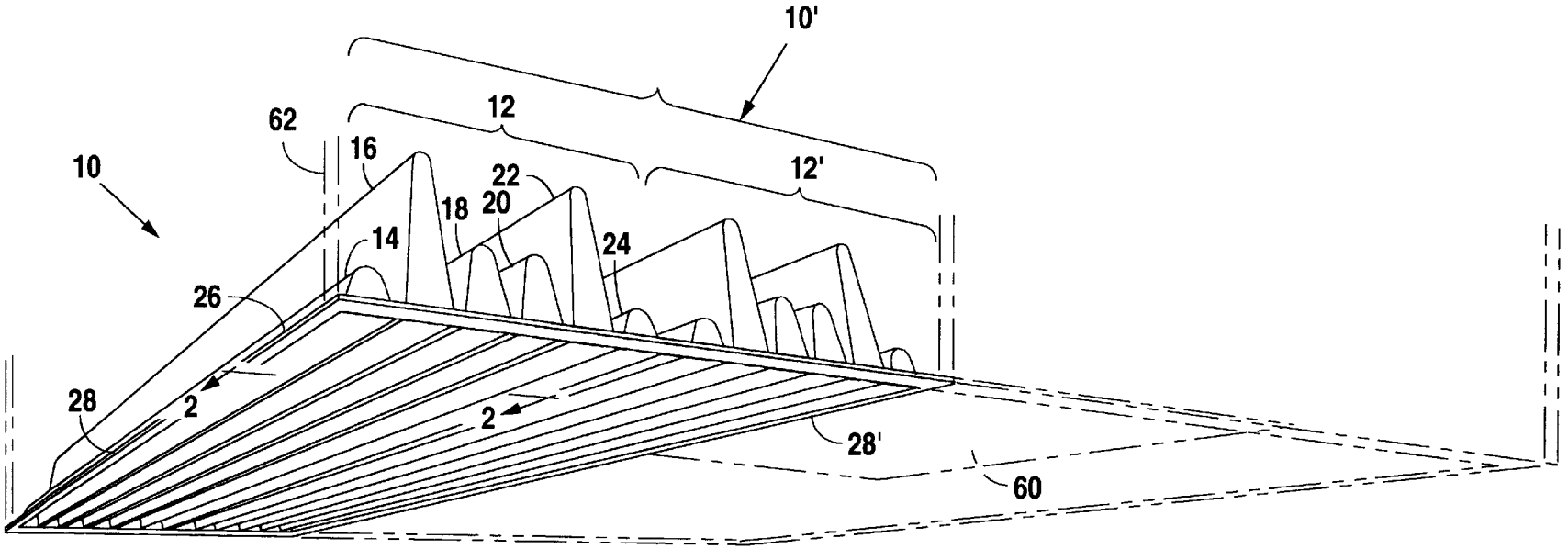
FIG. 3 shows the acoustic diffuser panel of FIG. 1 in place within a conventional lay-in ceiling tile grid for service as a sound diffuser.

Referring to FIG. 3, the acoustic diffuser panel 10, configured according to the example just described, for example, has twice the width and twice the length of a conventional acoustical ceiling tile 60 (shown in phantom). Because of this size of the panel 10, the panel 10 may replace, for example, four sections of the ceiling tile 60. When the panel 10 so replaces the ceiling tile 60, a conventional lay-in ceiling tile grid 62 (shown in phantom) supports and retains the panel 10. The outer lip 26 of the panel 10 resides atop the grid 62. Although a variety of types and sizes of the grid 62 are suitable, a heavy duty 15/16" size of the grid 62, which comprises ASTM C635 heavy duty main runners and 48" cross tees with hanger wire spacing 24" on center, is particularly effective. Also, it is particularly effective for supporting the panel 10 via the grid 62 to provide the panel 10 with support blocking (not shown) for additional hanger wire support at the center of the panel 10, however, such support blocking is not necessarily required.

Various moldable materials, such as fiberglass or thermofused plastic, are employable in manufacturing the panel 10. To manufacture the panel 10, a mold for forming the panel 10 with the desired wells is constructed, for example, of fiber reinforced plastic. The mold is configured with peaks each having heights corresponding to desired well depths according to the results of the quadratic residue number theory sequence. The mold is also configured with an edge bordering the peaks corresponding to the outer lip 26 of the panel 10. All surfaces of the mold with the peaks and edge are curvilinear.

Once the mold is constructed, the mold is first cleaned and waxed with a release agent. Then, one or more layers of fiberglass or other materials of high density and reflection are applied on the mold by spraying or layering. As shown in FIG. 2, the panel 10 is comprised, for example, of a fiberglass layer 64 and a catalyzed gel coat layer 66 bonded to the fiberglass layer 64 in a conventional manufacturing process. The fiberglass layer 64 comprises, for example, Ashland Chemical, Hetron 92AT Polyester Resin and 3 ounce biaxial chopped strand mat, and the gel coat layer 66 comprises, for example, Neste polyester gel coat having a wet film thickness of 16–20 mils. In the case of construction of the panel 10 with the fiberglass layer 64 and the catalyzed gel coat layer 66, the catalyzed gel coat is sprayed on the mold to about 1/8" thick and allowed to harden. The mold is thereafter layered with the biaxial chopped strand mat and the mat is saturated with the catalyzed resin. The mat may be cut to fit the mold prior to application to the mold.

After the catalyzed resin is applied to the mat, the mat is rolled into place on the mold atop the hardened catalyzed gel coat to remove air bubbles and to pack the mat firmly against the hardened catalyzed gel coat surface. Thereafter, the saturated mat is allowed to harden until semi-solid and then trimmed to the mold edge. After trimming, the saturated mat is allowed to cure, for example, overnight. In removing the hardened fiberglass from the mold, air pressure is applied between the mold and the hardened fiberglass and the hardened fiberglass releases from the mold. The hardened fiberglass is then finish sanded around the perimeter. The resulting piece is the panel 10.

Although the foregoing materials and specifications are expressly stated and described herein, it is to be understood that these particular materials and specifications are an example, and other materials, such as, for example, plastics and composites having similar physical characteristics, for example, material density and sound reflectivity, to the particular materials and specifications are possible alternatives and additions for manufacture of the panel 10. Generally, molding of fiberglass or plastic objects is conventional and, to the extent not expressly described herein, those skilled in the art will know and understand the various alternative and additional possibilities for manufacturing with fiberglass, plastic, and other similar materials.

In operation, the acoustic diffuser panel 10 may be placed in service in a variety of environments where sound diffusion is desired, such as, for example, theaters, concert halls, sanctuaries, production studios, and others. In such service, the panel 10 may be suspended from a ceiling, such as by the ceiling tile grid 62 shown in FIG. 3, placed on or erected as part of or as attached to a wall enclosing the environment, or otherwise maintained in the vicinity of sound. In placing panel 10 on a wall, an identical or similar grid to the ceiling tile grid 62 may be employed and the panel 10 may be retained lodged in the grid by adhesive, screws, rivets, clamps or other similar mechanisms. In any event when the panel 10 is so used, sound incident to the lower side (as viewed in FIGS. 1 or 2) of the panel 10 from any direction is uniformly diffused into many directions. In this manner, the panel 10 serves as a reflection phase-grating that scatters equal sound intensities into all diffraction orders, except in the specular direction.

The present invention has several advantages. For example, the panel 10 can diffuse sound into many directions because of the varying well depths and the curvilinear surfaces defining the wells and the whole of the panel 10. The diffusion achieved is greater than achieved with squared wells with right angles. Further, diffusion of a range of sound frequencies is possible because of the varying well depths, rather than uniform well depths and peaks. Another advantage is that the panel 10 is fabricated by molding, as a single integral unit. The fabrication is less tedious and less costly than the fabrication of other types of panels, such as those comprised of a composite of pieces. This fabrication by molding the panel 10 is possible because of the canted side walls. Yet another advantage is that the panel 10 can replace conventional acoustical ceiling tiles in a conventional ceiling tile grid 62. Thus, the panel 10 is easily and readily placed and maintained for service in an application.

Several variations may be made in the foregoing without departing from the scope of the invention. The embodiments of the present invention, for example, are not limited or restricted as to sizes of the panel 10, well configuration, well widths and depths, and other measurements. Also, the panel 10 may be configured with additional or fewer wells according to the desired sizes of the panel 10 and wells. The panel 10 may have any number of wells and sequences of wells, though the numbers preferably correspond to a prime number in accordance with the quadratic residue number theory sequence and to desired sizing and weighting, for example, sizing and weighting suitable to replacement of conventional ceiling tiles. The panel may even comprise fractions of sequences. For example, diffuser panels having fractional sequences may serve as complementary panels to other panels in order to, in combination, effectively simulate a single panel of the size of the combination. Panels having fractional sequences may be desirable, for example, when relatively low frequency sound (i.e., sound of large wavelengths) yields calculations of well widths which are too large for panels supportable by conventional ceiling tile grids.

In further variations, the entirety of the acoustic diffuser panel 10 may be covered by an open weave fabric for aesthetic or functional reasons. The fabric may be installed over the entirety or portions of the panel 10, including top, bottom, sides, front and back. In addition to improving aesthetics of the panel 10, the fabric also functions to absorb sound and to allow sound to pass through to the fiberglass where the sound is reflected. A suitable fabric for the panel 10 is Guilford open weave panel fabric, model number FR701. The fabric is attached to the panel 10 by conventional means, such as by an adhesive. Various other fabrics are also useable. In any event, the fabric desirably has an open weave that allows sound to penetrate the fabric material and to be absorbed, and that enables the dense and reflective underlying surface of the panel 10 to reflect the sound for diffusion.

Although illustrative embodiments of the invention have been shown and described, a wide range of modification, change, and substitution is contemplated in the foregoing disclosure and, in some instances, some features of the present invention may be employed without a corresponding use of the other features. Accordingly, it is appropriate that the appended claims be construed broadly and in a manner consistent with the scope of the invention.

What is claimed is:

1. An acoustical diffuser for diffusing sound having a range of frequencies from a lowest frequency to a highest frequency, comprising:

a panel having a plurality of wells formed thereon;

wherein the wells each have particular width equal to the speed of sound divided by the product of two times the lowest frequency and the wells each have different particular depth equal to a value of a quadratic residue number theory sequence, $n^2$(modulus), multiplied by a constant equal to the frequency wavelength of the lowest frequency divided by the product of two times the modulus, wherein the modulus is a lowest prime number exceeding a quotient of the highest frequency divided by the lowest frequency and n is equal to each integer from 0 to the modulus minus 1.

2. The acoustical diffuser of claim 1, wherein the plurality of wells of the panel is a number of wells equal to the modulus.

3. The acoustical diffuser of claim 1, wherein the panel comprises an outer lip suitable for supporting the panel in place for service.

4. The acoustical diffuser of claim 1, wherein the panel includes a surface of the wells consisting essentially of curvilinear surfaces.

5. The acoustical diffuser of claim 1, wherein the wells each comprise a first side wall and a second side wall connected by an arcuate top, the first side wall and the second side wall each being skewed from the other.

6. The acoustical diffuser of claim 2, wherein the panel comprises an outer lip suitable for supporting the panel in place for service.

7. The acoustical diffuser of claim 2, wherein the panel includes a surface of the wells consisting essentially of curvilinear surfaces.

8. The acoustical diffuser of claim 3, wherein the panel includes a surface of the wells consisting essentially of curvilinear surfaces.

9. The acoustical diffuser of claim 3, wherein the wells each comprise a first side wall and a second side wall connected by an arcuate top, the first side wall and the second side wall each being skewed from the other.

10. The acoustical diffuser of claim 2, wherein the panel comprises an outer lip suitable for supporting the panel in place for service, the panel includes a surface of the wells consisting essentially of curvilinear surfaces, and the wells each comprise a first side wall and a second side wall connected by an arcuate top, the first side wall and the second side wall each being skewed from the other.

11. A system for diffusing sound of frequencies in a range from a lowest frequency to a highest frequency, comprising:

a panel formed with curvilinear wells equal in number to a next successive prime number greater than a quotient of the highest frequency divided by the lowest frequency.

12. The system of claim 11, further comprising:

a tile grid for retaining and supporting the panel in service.

13. The system of claim 11, wherein the curvilinear wells each have particular width equal to the speed of sound divided by the product of two times the lowest frequency and the curvilinear wells each have different particular depth equal to a value of a quadratic residue number theory sequence, $n^2$(modulus), multiplied by a constant equal to the frequency wavelength of the lowest frequency divided by the product of two times a modulus, wherein the modulus is a next successive prime number greater than a quotient of the highest frequency divided by the lowest frequency and n is equal to each integer from zero to the modulus minus one.

14. The system of claim 13, further comprising:

a tile grid for retaining and supporting the panel in service.

* * * * *